United States Patent [19]

Scribner

[11] 3,935,600

[45] Feb. 3, 1976

[54] SWIMMING POOL

[76] Inventor: William N. Scribner, 1237 Linworth Ave., Baltimore, Md. 21212

[22] Filed: Apr. 1, 1974

[21] Appl. No.: 456,613

[52] U.S. Cl. ..... 4/172.13; 187/8.72; 187/18

[51] Int. Cl.[2] ..... E04H 3/16; E04H 3/18

[58] Field of Search..... 4/172.13, 172.14, 172.11, 4/172.12; 187/8.71, 8.72, 18

[56] References Cited

UNITED STATES PATENTS

| | | | |
|---|---|---|---|
| 900,237 | 10/1908 | Trent | 187/18 |
| 1,727,182 | 9/1929 | Smith | 187/8.71 |
| 2,598,625 | 5/1952 | Wallace | 187/8.71 X |
| 2,624,535 | 1/1953 | Bollhoefer | 187/8.72 X |
| 2,890,908 | 6/1959 | McLean | 187/18 X |
| 2,975,868 | 3/1961 | Long | 187/18 |
| 3,413,661 | 12/1968 | Ross | 4/172.13 |
| 3,670,343 | 6/1972 | Gansloser | 4/172.13 |

*Primary Examiner*—Henry K. Artis

*Attorney, Agent, or Firm*—J. Wesley Everett

[57] ABSTRACT

An adjustable bottom for swimming pools wherein the raising and lowering mechanism is self-locking including positive and gradual movement in the raising and lowering of the adjustable bottom including means outside the pool for operating the mechanism.

1 Claim, 4 Drawing Figures

SWIMMING POOL

The present invention relates to an adjustable bottom for swimming pools which may be adjustable in order that the water in the pool be of a desired depth which is desirable for a number of reasons. For example, the pool should be shallow for small children or those who do not swim, while for those who do wish to swim and possibly dive into the water, the depth of the water in the pool may be made deeper.

One object of the invention is to provide an adjustable bottom for swimming pools which is held rigid in any of a number of selected positions.

Another object of the invention is to provide a positive and gradual adjusting mechanism.

A further object of the invention is to provide means for securing the movable bottom in a number of selected positions.

While several objects of the invention have been pointed out, other objects, uses and advantages will become apparent as the nature of the invention is more fully disclosed with reference to the accompanying drawings in the following description wherein.

In referring to the drawings like and similar reference numerals refer to like and similar parts throughout the several views.

Figure 1:
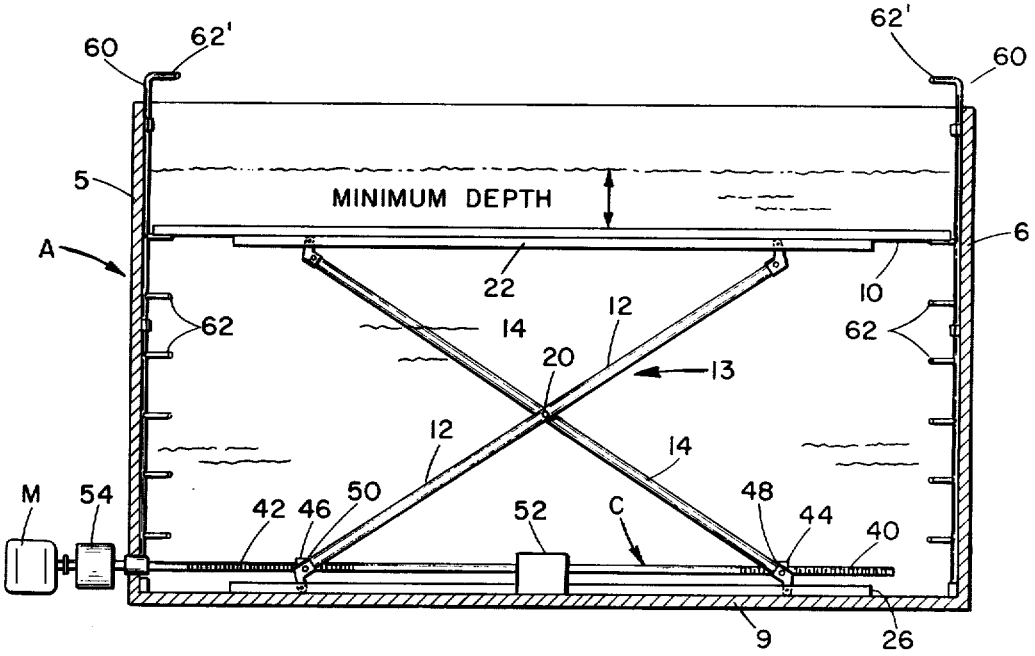
FIG. 1 is a sectional vertical view of a pool illustrating the adjustable bottom adjacent its upward position for allowing a minimum depth of water in the pool.

The pool is designated in general by the letter A having sides 5, 6, 7 and 8 and a permanent bottom 9. For convenience the pool is shown as square but may be rectangular in shape or in any other particular shape in which a movable bottom may be operated.

The depth of the pool is determined by the adjustable bottom member 10. Floor 10 is adjustable as shown particularly in FIGS. 1 and 2. The mechanism for adjusting the bottom comprises a pair of hinged members B and B′ positioned at each side of the pool. Each of the members B and B′ comprise at least two elements 12, 14 and 16, 18 hinged at their centers by rod 20 or if preferred by a single supporting pin (not shown).

Extending beneath and fixed to the bottom 10 are tracks 22 and 24 for accomodating rollers 30, 30′, 32 and 32′ fixedly secured to the upper ends of the members 12, 14, 16, 18.

Along the bottom 9 of the pool A there is provided tracks 26 and 28 for accomodating rollers 34, 34′, 36, 36′.

Figure 2:
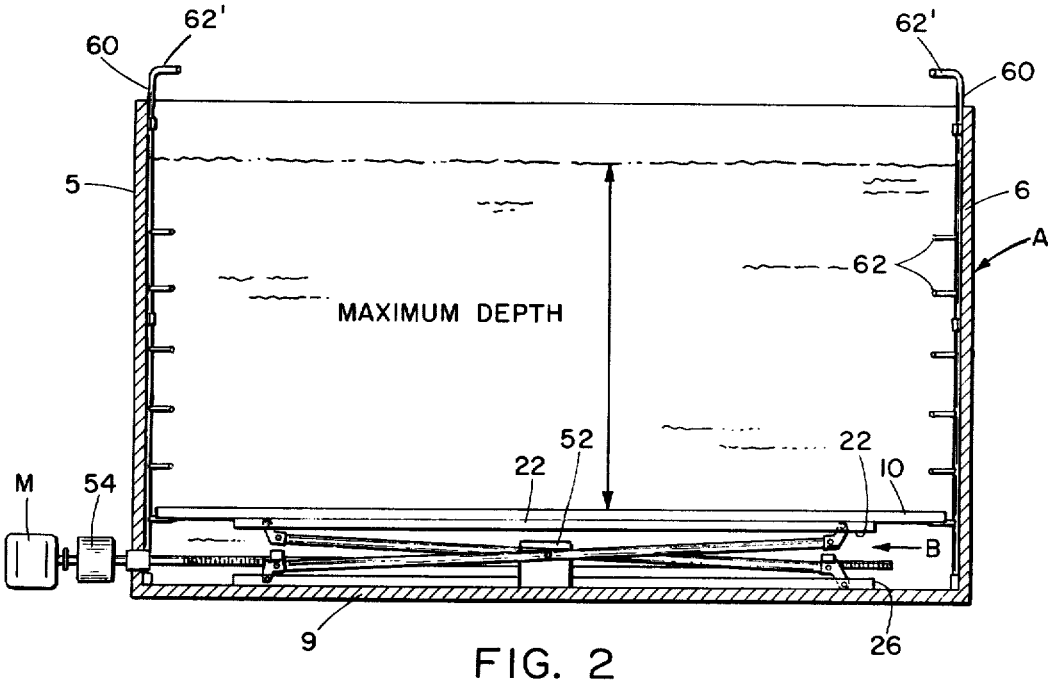
FIG. 2 is a sectional vertical view of the pool similar to that shown in FIG. 1 wherein the adjustable bottom is positioned at the bottom of the pool wherein the water is shown at its maximum depth.
Figure 3:
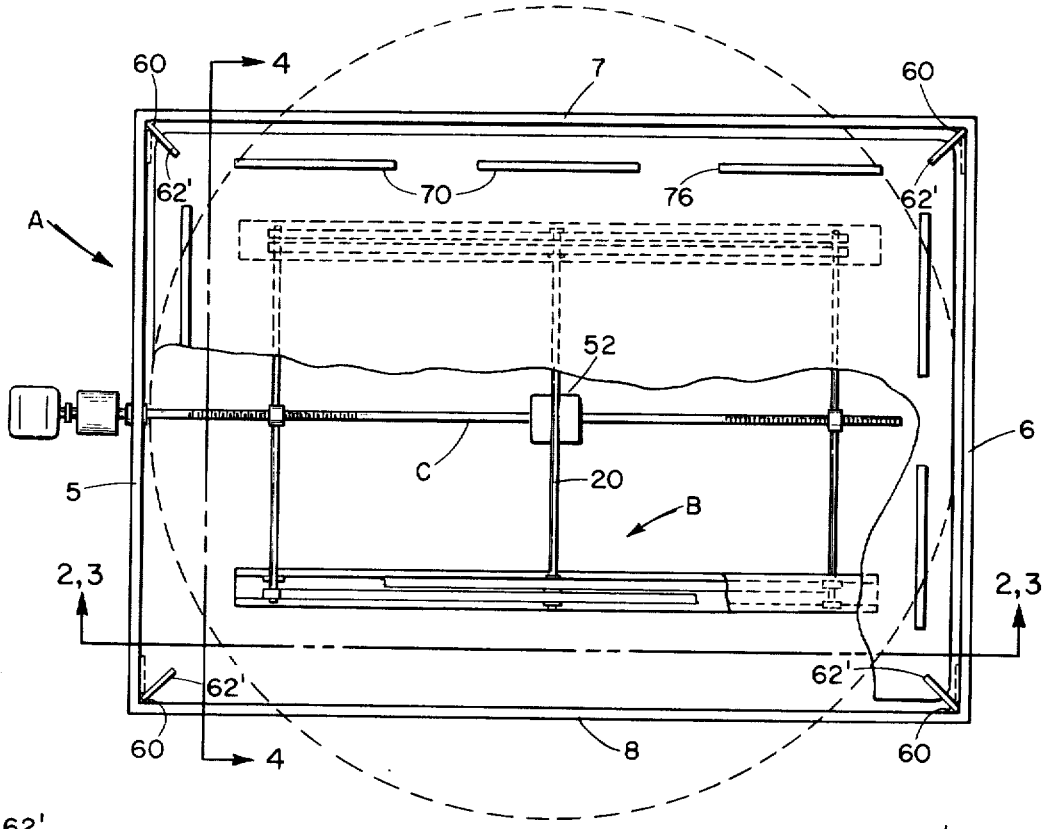
FIG. 3 is a top plan view of the pool and adjustable bottom, the adjustable bottom being partly broken away to show the supporting tracks carried on the under side of the adjustable bottom.
Figure 4:
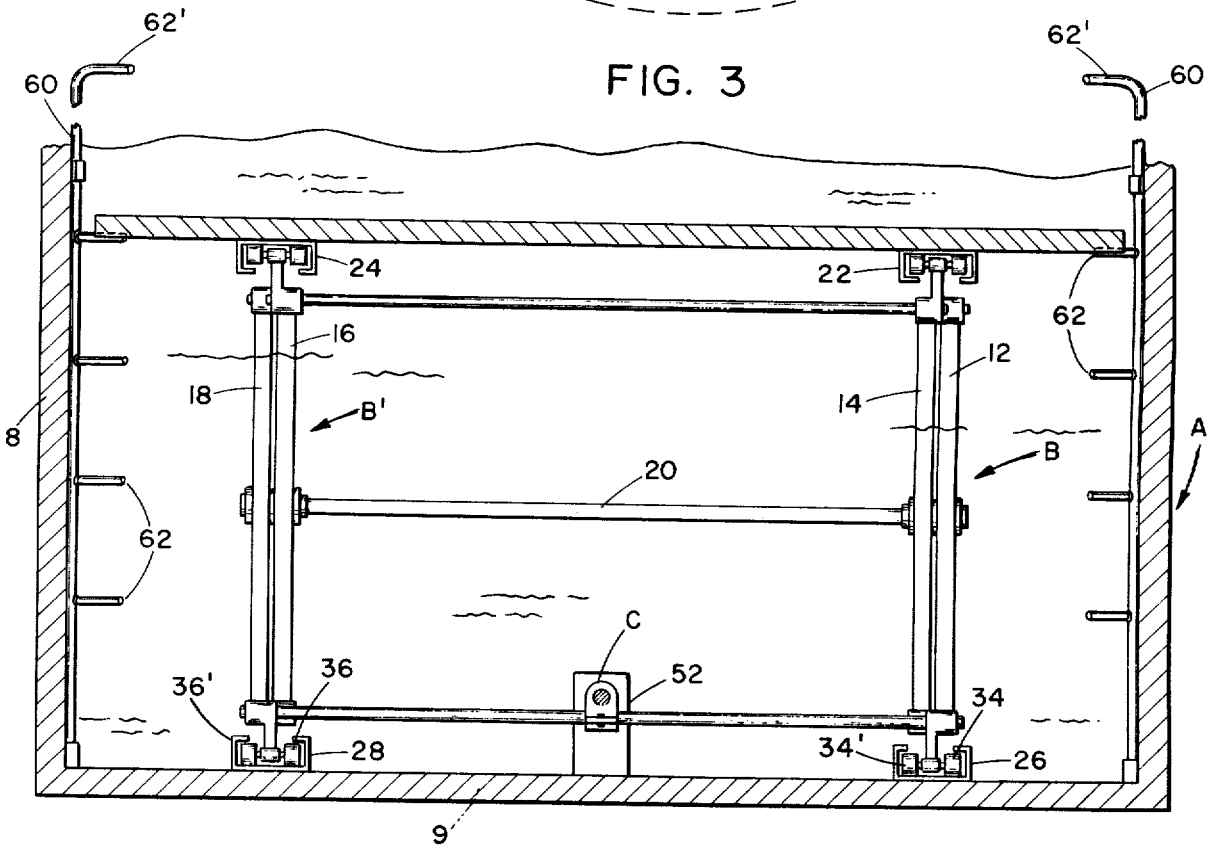
FIG. 4 is a sectional view taken on line 4—4 of FIG. 3.

These members B and B′ are extended and retracted by means of a double screw member C having a reversed thread 40 and 42, one at each end of the member C. Secured to the lower end of the cross members as shown in FIGS. 1 and 2 are threaded nuts 44 and 46. These nuts are pivotally mounted on the cross members by pins 48 and 50. Adjacent the center of the screw member C is a supporting bearing 52 including a universal joint 54. The screw member C is operated in either direction by a motor M through a gear box 54. The wiring for a reversible motor is not shown as this is well known in the field of electric motors and has no bearing on the present invention.

The pool is provided preferably in its corners with vertical pivot member 60 having member 62 extending laterally therefrom for supporting the floor 10 when in adjusted position. The members 60 are rotatable by a handle member 62″.

In operation, after determining the depth of the water to be used in the pool, the members B may be adjusted to any position for positioning the movable floor. For example, if the members B and B′ are completely collapsed as shown in FIG. 2, the floor 10 is at its lowest point and the depth of the water in the pool is at its maximum. In order to reduce the depth of the water between the removable bottom 10 and the upper surface of the water the motor M is energized and operated in the direction to cause the members 44 and 46 to move along the screw C in the direction of the center bearing 52. The operation of the movable bottom is not begun until the corner supports are rotated by the handle member 62′ to move the support 62 out of the path of the adjustable floor. While operating the screw C the members 12 and 14, see FIG. 1, are drawn toward each other which causes the opposite ends of the members 12 and 14 supporting the floor 10 to move upwardly to any desired point within the limits of the operation. When the desired point is reached by the adjustable floor the motor M is de-energized and the floor supporting members 62 are again moved inwardly under the floor 10 at the corners of the pool for positive support of the floor against accidental displacement which may increase the depth of the water and become dangerous for young children and those who do not swim.

The water in the pool is always of substantially the same amount. The movable bottom moves through the water at a very slow speed which allows water in the pool to pass through the openings 70 in either direction the floor is moved.

The advantage of having an adjustable bottom is that it is possible to use the same pool for young children and those who do not swim by having the water shallow and also enable adults to use the pool who desire the water in the pool deeper, for swimming and diving.

The invention has been illustrated and described in simple form illustrating the principle involved. However, it is not intended as a limitation as the elements may be modified in any number of ways without moving out of the area of equivalence to which the invention is entitled. What is new and desired to be covered by Letters Patent is set forth in the appended claims.

I claim:

1. A swimming pool having a liquid tight permanent bottom and side walls and a horizontal auxiliary vertically adjustable bottom positioned above the permanent bottom, having means for raising and lowering the said auxiliary bottom relative to the permanent bottom, comprising;

a. the auxiliary bottom being of a size slightly less in dimension than the permanent bottom to enable the auxiliary bottom to be moved vertically within and adjacent the inner surface of the side walls of the pool;

b. the means for raising and lowering the auxiliary bottom comprising a pair of elongated vertically arranged hinge supports positioned at two opposite sides of the pool, one pair of supports positioned one at each side of the pool and between the auxiliary bottom and the permanent bottom;

c. each pair of supports being hinged at a point adjacent their centers;

d. roller means fixed to the lower and upper ends of each of the hinged supports;

e. a pair of tracks positioned over and along the under surface of the auxiliary bottom and over the upper surface of the permanent bottom extending in a plane with the hinged supports for receiving the said rollers, the length of the tracks being substantially the length of the under surface of the auxiliary bottom;

f. means for moving the rollers along the tracks comprising a pair of threaded blocks connected to the lower ends of each of the hinged supports, including a shaft extending substantially the full length of the pool in a plane parallel with the hinged supports, having right and left hand threads on its opposite ends for threadedly engaging one of the said blocks at each end of the shaft.

g. means positioned outside the pool for rotating the shaft in either direction;

h. perpendicular stationary locking means spaced over the edge of the pool for fixing the selected positions of the auxiliary bottom, said stationary locking means having projections extending horizontally therefrom for engaging the underside of the auxiliary bottom, side stationary locking means being rotatable in a horizontal plane to an angle of at least 45° for moving the horizontal projections in and out of engaging position with the auxiliary bottom for locking the same in position when in one position and out of locking position when in another position.

* * * * *